US007549709B2

(12) United States Patent
Kussel

(10) Patent No.: US 7,549,709 B2
(45) Date of Patent: Jun. 23, 2009

(54) MINING DEVICE

(75) Inventor: Willi Kussel, Werne (DE)

(73) Assignee: Tiefenbach Control Systems GmbH, Essen (DE)

( * ) Notice: Subject to any disclaimer, the term of this patent is extended or adjusted under 35 U.S.C. 154(b) by 0 days.

(21) Appl. No.: 11/855,781

(22) Filed: Sep. 14, 2007

(65) Prior Publication Data

US 2008/0054705 A1 Mar. 6, 2008

Related U.S. Application Data

(63) Continuation of application No. PCT/DE2006/000488, filed on Mar. 17, 2006.

(51) Int. Cl.
*E21D 23/12* (2006.01)

(52) U.S. Cl. ..... 299/1.6; 299/1.7

(58) Field of Classification Search ..... 299/1.2, 299/1.6, 1.7

See application file for complete search history.

(56) References Cited

U.S. PATENT DOCUMENTS

| | | | | |
|---|---|---|---|---|
| 4,008,921 | A | 2/1977 | Czauderna et al. | |
| 4,228,508 | A | 10/1980 | Benthaus | |
| 4,776,637 | A * | 10/1988 | Dawson | 299/1.6 |
| 4,952,000 | A * | 8/1990 | Lipinski et al. | 299/1.6 |
| 6,361,119 | B1 * | 3/2002 | Kussel | 299/1.6 |
| 2004/0196160 | A1 | 10/2004 | Wesselman | |

FOREIGN PATENT DOCUMENTS

| | | |
|---|---|---|
| DE | 100 18 481 A1 | 9/2002 |
| DE | 203 05 309 U1 | 6/2004 |

OTHER PUBLICATIONS

International Search Report for PCT/DE2006/000488, completed Jun. 13, 2006, mailed Jun. 21, 2006.

* cited by examiner

*Primary Examiner*—John Kreck
(74) *Attorney, Agent, or Firm*—Alston & Bird LLP

(57) ABSTRACT

The invention relates to a mining device that is used at the face of a mine, said device comprising a sensor that is mounted on the planer for identifying the rock and transmitting rock data for no more than two measuring points per extraction unit via radio to each extraction control device. The measuring signals of adjacent measuring points are evaluated with respect to the prevalence of rock or coal. Based on said evaluation, the tilting unit that is common to the measuring points is controlled with regard to the raising or lowering of the planer. Each tilting unit is allocated an inclinometer, whose measured value of the inclination of the channel in the transversal direction of the latter is fed to the extraction control device and compared with the tilt signal that is generated by the evaluation. Each inclinometer is equipped with a radio transmitter for the radio transmission of the inclination signals to the assigned extraction control device. Each inclinometer is equipped with a power supply battery, which is activated by a radio signal of a transmitter that is provided on the planer and is deactivated after a time lapse.

10 Claims, 1 Drawing Sheet

26
24
27
20
24
21
25
12
11
17
5
4
28
16
15
9
3
22
23
18

MINING DEVICE

CROSS-REFERENCE TO RELATED APPLICATIONS

The present application is a Continuation of International Application No. PCT/DE2006/000488, filed Mar. 17, 2006, and which designates the U.S. The disclosure of the referenced application is incorporated herein by reference.

FIELD OF THE INVENTION

The invention concerns a mining device in the longwall face of a mine.

BACKGROUND OF THE INVENTION

Such a control is known, for example, from DE 100 18 481 A1 (TBT 9905). In that case a number of radio receivers are placed in the longwall face, which are connected in series with a central control in the head gate (longwall face control device). Each radio receiver addressed continuously receives information from the rock sensor and passes on this information to the longwall face control device for evaluation. In the longwall face control device it is then calculated, whether the planer is still traveling in the area of the coal face or breaks already in the boundary layers of the rock. Depending on this, the planer has to be raised or lowered. The raising of the planer (climbing) is carried out by lowering the edge of the chute, whereby the planer tilts about a sliding block, provided in the area of the centre of the width of the chute. The lowering of the planer (plunging) is carried out in reverse in that the edge of the chute, adjacent to the extraction devices, is raised by a tilting device and consequently the planer is pivoted in the opposite direction about the sliding block.

An object of the invention is to make the control so fast, that the position of the planer could be possibly corrected with regard to climbing or plunging while the extraction is still taking place, but in any case during the following return travel.

SUMMARY OF THE INVENTION

The present invention in one embodiment is based on the realization, that the speed of the control is impaired particularly by the amount of the transferred data, however, the amount of data limited in accordance with the invention is adequate for an operationally optimal control of the planer. In the region of the extraction unit preferably only two measurements are carried out basically at the same height.

The development according to another embodiment serves the purpose of further reducing the amount of data to be transferred and to increase the speed of the control. By this configuration additional reliability is also achieved, since the connection of the radio receiver by means of a cable running along the chute becomes superfluous.

The shield control unit of each extraction unit is connected with a radio receiver. Because only a short distance, practically no greater than 3 m, has to be bridged over by the radio signal, for a perfectly reliable transmission only a modest radio output is required. The received signals can then be exchanged via the busbar which connects the shield control devices of all extraction units with one another and with the longwall face control device and processed.

The configuration according to another embodiment serves the purpose of further acceleration of the control operations by virtue of that the processing can be carried out in every shield control unit, in particular, however, in that shield control unit which is closest to a tilting device and is allocated to it.

According to a development of this embodiment for the purpose of evaluation, the rock data is collected in the adjacent shield control devices, in particular in that shield control unit of the group that is allocated to the respective tilting device, and evaluated according to whether in these rock signals the "rock" or "coal" signals prevail. For this purpose each shield control device is equipped with its own computing and control capacity, so that with the aid of a program, preferably stored in each shield control device, it can be determined whether in the region of the extraction units traveled through last the planer breaks mostly rock or coal. By evaluating the rock data, collected on several adjacent extraction units, it will be decided by the program stored in the relevant shield control device or longwall face control device, or manually, as to for what length the position of the planer should be altered regarding climbing or plunging.

In the case of the alternative or additional development according to another embodiment a pre-evaluation of the measured rock signals is carried out in a microprocessor carried on the planer. This pre-evaluation can extend that far, that only simple "black/white signals" "coal or rock" have to be transmitted by the radio allocated to the rock sensor.

According to another embodiment the device is fitted with inclinometers for the purpose of moving the position of the control to decide as to what length of the recognized rock the position of the planer should be altered. To transfer all measuring signals via a busbar positioned along the conveyor these inclinometers can be connected to the longwall face control device.

The configuration according to another embodiment serves the purpose of reducing the amount of data flowing through the longwall face control device.

At the same time to save the expense of additional cabling for the radio receiver, according to a development in accordance with another embodiment the radio receiver for the inclination signals is directly allocated to that shield control device, which is closest to the inclinometer. As a rule, this is that shield control device which in the configuration according to some embodiments is positionally and functionally allocated to the tilting device.

In this case there is the further problem, that cabling is required to supply current to the inclinometer and the associated transmitter. This is avoided with the configuration according to another embodiment. At the same time the configuration according to another embodiment ensures a long service life and long period of holding the charge of the battery. In this regard this embodiment makes use of the fact, that the measuring and transmission function of the inclinometer is of very short duration (e.g. 5-10 sec) during the period of travel of the planer past a certain number of extraction units which are allocated to the inclinometer, to transfer the rock data at, for example, two measuring points per extraction unit. For this reason the activation of the supply to the battery of the inclinometer and of the transmitter mounted on the inclinometer is carried out by the travelling planer, for example by a specifically coded radio signal of the planer or by a sensor of the planer. Thus the switching off of the battery supply can be carried out after to a pre-set period of time.

BRIEF DESCRIPTION OF THE DRAWINGS

The inventive method will be described in more detail hereinbelow with the aid of an exemplary embodiment of the inventive apparatus, with reference to the accompanying drawings.

DETAILED DESCRIPTION OF PREFERRED EMBODIMENTS

Figures 1, 2:
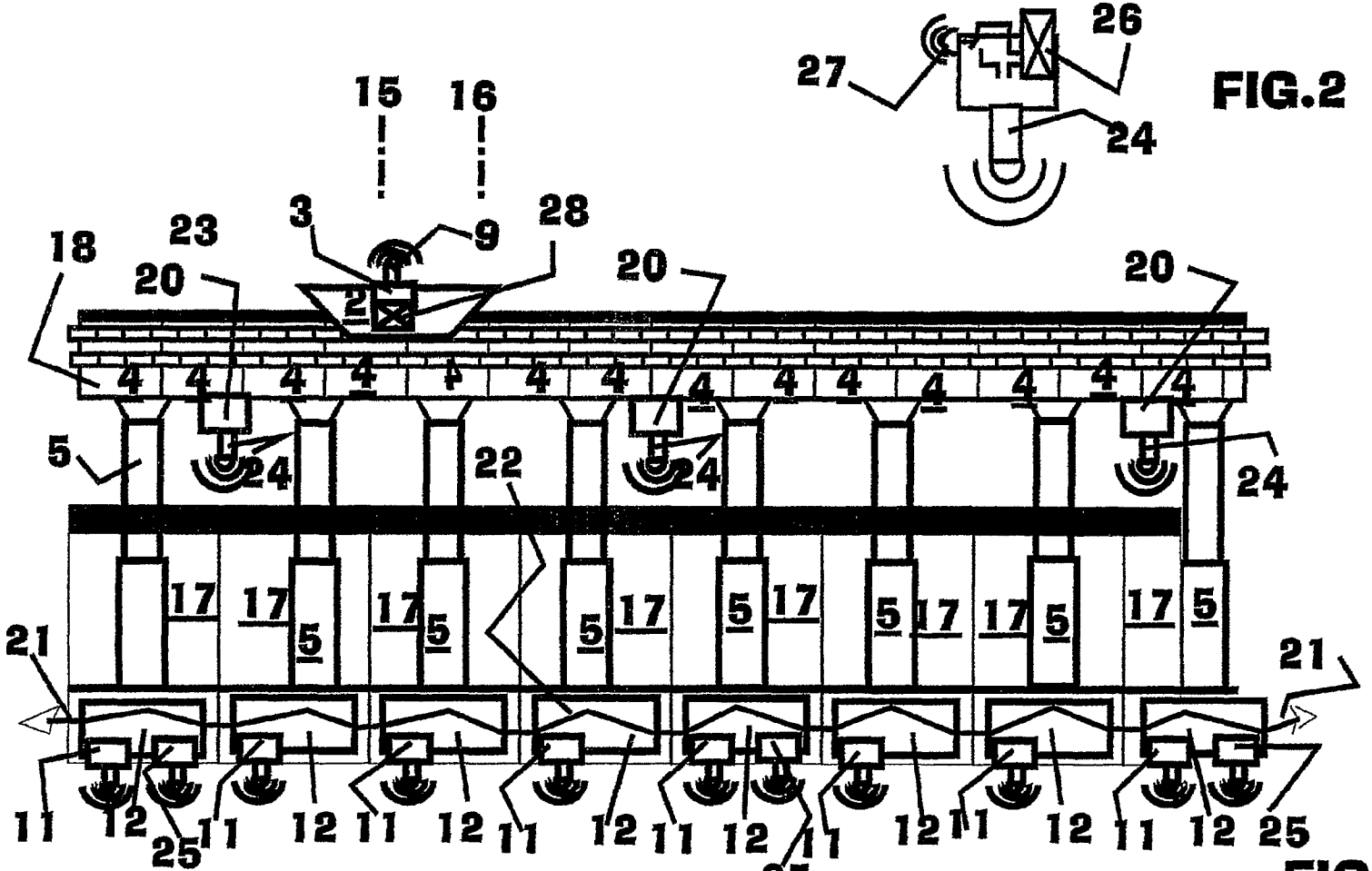
FIG. 1 schematically shows the top view of a longwall face as an embodiment.
FIG. 2 shows a detail of an inclinometer.

The planer 2 is pulled back and forth by the conveyor chain 23 along the coal face (not illustrated) at a great speed (e.g. 3 m/sec) through the longwall face (e.g. 300 m long). At the same time the planer is guided on the chute 18 made up from components 4. The broken-up coal is conveyed in the chute to one of the longwall face ends. The longwall face is covered and supported upwards by a row of extraction units (shields), which are erected tightly next to one another on that side of the chute which faces away from the coal face, and in addition to their function of supporting the rock have also the function to support the chute in the direction of the coal face and advance the chute components toward the extraction of the coal face. Each extraction unit further has a tilting device 5, that will be described in the following.

Furthermore, each extraction unit has a shield control device, extraction control device 12 to control the functions to be carried out by the individual extraction units, in particular pulling-in (robbing), advancing (stepping) and positioning and bracing (setting). The extraction units of a longwall face are connected with one another by a busbar, via which commands, measuring signals and radio signals can be conveyed to each shield control device and finally also to the longwall face control device and/or the central control unit via a connecting cable 21.

The planer 2 is fitted with a rock sensor 3 and an associated microprocessor 28. Such rock sensors are known and are supplied, for example, by the company TEC5-AG in Oberursel. Their task is to continuously analyse the rock and/or coal appearing in the cutting region of the planer on the excavation front of the seam passed by and recognize whether the tools of the planer tackle in the region of the seam (coal) or they leave the seam upward or downward (rock). Depending on this the chute 18 or adjacent chute components will be pivoted about the central support sledge (not illustrated) or that on the side of the coal by extending or retracting the tilting device 5 constructed as a cylinder-piston unit (tilting cylinder) in the plane that is perpendicular to the direction of conveying (direction of the conveyor chain 23) in such a manner, that at the same time the tools of the planer are placed deeper (plunge) on the coal face when the rock sensor establishes that the seam falls in the direction of travel of the planer, or are set higher (climb) on the coal face when the rock sensor establishes that the seam rises in the direction of travel of the planer. Tilting cylinders 5 are illustrated for each extraction unit. Depending on the circumstances it may be sufficient to provide a tilting device/tilting cylinder on each $6^{th}$ to $12^{th}$ extraction unit.

It should be noted, that to a certain extent inclines of the seam may also occur by adjusting the chisel and in particular the ground chisel, so that the plunging or climbing by pivoting the chute components has to be applied only in the case of unusual geological conditions.

It is of particular significance for the conveying capacity of the plant to transmit the relevant control commands to pivot the chute components as fast as possible to the control, in particular to the control of the longwall face and the central control, so that the vertical position of the planers could be possibly adjusted by plunging or climbing during travel, but latest during the return travel. In the case of existing plants this impairs the data flow, that with the usual free computer capacities cannot be overcome fast enough. Therefore provision is made not to carry out the measuring via the rock sensor continuously, only from time to time, in fact preferably during the forward travel of the planers in the region of an extraction unit 17 (approx. 1.50 m) only twice at the measuring positions 15 and 16. The measuring is carried out in areas which are essentially at the same height. It has come to light, that with this an adequately accurate recognition of the rocks is feasible for the purpose of controlling the planer, what also has the advantage, that the climbing and plunging of the planer can take place within the shortest possible time, so that on the one hand no rock will be quarried, and on the other always the maximum possible coal face will be removed. In this conjunction it has to be recognized:

- that due to the masses and forces to be managed the setting and the control of the planer's position cannot take place as fast as it may be desirable,
- that in the case of a speed of the planer of, for example, 3 m/sec a longwall face of 300 m length is travelled back and forth in less than 3 min, and
- that in this short period hardly more than 4 corrections of the planer's adjustment can be carried out.

These corrections are carried out on the basis of evaluation and in particular of the average of the measured values, which are obtained between two (or also more) corrections of the planer's position.

To speed up the availability of a measuring signal that can be evaluated, the rock sensor is also fitted with the microprocessor 28 illustrated, that is carried on the planer. By means of this microprocessor a first evaluation of the data of the rock sensor is carried out in that sense, that the output signal, transmitted from the rock sensor by means of the radio 9, is understood and evaluated without time-consuming evaluation and in the best case already contains the unambiguous information: "rock" or "coal".

For a further speeding up of the transfer and processing of the rock data the rock sensor 3, as mentioned, is fitted with a radio transmitter 9, that transfers the rock data, possibly after and in the form of the described evaluation by the microprocessor 28, to a radio receiver 11, of which one each is allocated to each extraction control in each extraction unit. The radio traffic is therefore limited to a relative small and unambiguous amount of data and to the distance of never more than 3 m, since there is only a short intermediate space between the transmitter 9 and each of the receivers 11. The transferred data is conveyed further from the receiving extraction control via the busbar 22 to the longwall face control device and the central control unit. The large computer capacity available there is sufficient to quickly evaluate the received data and to decide, based on the signal (coal or rock is at the bottom of the coal face) whether the position of the conveyor/position of the chute components has to be adapted by plunging or climbing to suit in a region of the length of the longwall face or along the entire length of the longwall face.

For this decision and in particular for the automation of this decision making and adjustment in the sense of an automatic control the position of the chute and/or the chute components are also conveyed to the longwall face control device and the central control unit. For this purpose several inclinometers 20 are fastened on the chute, to each of which a group of adjacent chute components are allocated. When a tilting device is not allocated to each extraction unit, only, for example, to each $6^{th}$ extraction unit, then an inclinometer is provided on the chute in the area of attachment on the relevant tilting device or on the chute component that is engaged by the tilting device. Consequently one inclinometer covers a group of chute components. In the case illustrated such a group comprises five or six adjacent chute components. Each inclinometer 20 is provided with a radio transmitter 24. The inclination of the chute is transmitted by this transmitter to a radio receiver 25, that is connected to the extraction control device 17 of that extraction unit which is the closest opposite the inclinometer 20. In this case special radio receivers 25 are indicated; however, when the rock data and the inclination data are transmitted with different coding, the reception of the inclination data can be also carried out by the already mentioned radio receiver 11, so that the receiving extraction control can decide whether it deals with rock data or inclination data. The inclination data is further conveyed to the longwall control device and the central control unit from the receiving excavation control device 12 via the busbar 22 and the connection 21.

It should be noted, that in this case the position indicator (not illustrated), of which one is allocated to each extraction unit, determines the presence of the planer and reports it to the longwall face control device and the central control unit via the allocated extraction control unit. Other types of determining the position are also conceivable, cf. for example, DE 199 82 113.5-24.

The electric energy for the radio transmission is supplied to the individual inclinometers via a battery 26 accommodated in each inclinometer. To save energy, each inclinometer has a sensor 27 (e.g. transponder), that determines the presence of the planer and as a function of the approaching of the planer switches on the energy supply and switches it off as the planer moves away. In this manner it is possible to carry out the measuring operations in the relevant phases of the planer's travel without the cables to the inclinometers with them disturbing the mining operations.

FIG. 2 shows an inclinometer 20, enlarged. Each inclinometer can be supplied with current via a battery 26 or the like. For this purpose the inclinometer has a sensor 27, e.g. a transponder, light emitter/receiver or the like, that in the case of an adjustable approach of the planer closes the switch that supplies current to the radio transmitter 24, and after having travelled past, depending on the distance or also on the time passed, opens it again. By virtue of this the energy consumption can be so reduced, that the inclinometer can operate not only without cable but also remain maintenance-free over a long period of time.

That which is claimed is:

1. A mining device in the longwall face of a mine comprising:

a plurality of extraction units, which are erected adjacent to one another in the longwall face between sections;

a planer that can travel along the coal face with a sensor mounted on the planer to recognize the rock, said sensor transmitting by radio the rock data recognized to an extraction control device by means of a transmitter mounted on the planer and by means of radio receivers provided along the longwall face;

a chute and a conveyor running therein, which extend along the length of the longwall face between the mining machine and the extraction units;

a plurality of tilting devices, wherein adjacent extraction units and chute components are allocated in groups to a tilting device each and the tilting device is connected with the extraction control device of one of the extraction units of the respective group, and wherein depending on the rock data recognized by means of the respective tilting device the chute components of the group can be raised in the sense of plunging and lowered in the sense of climbing the planer tools;

a control device that has a longwall face control device at the end of the longwall face for the purpose of controlling the extracting functions of the extraction units in the sense of robbing, stepping, setting as well as extraction control devices, each of which is positionally and functionally allocated to the extraction units to convert and convey the extraction commands of the longwall face control unit; and a busbar connected, in series, with a longwall control device and the extraction control devices, wherein during the traveling past in the region of each extraction unit the rock sensor emits a measuring signal for the recognized rock for limited measuring points, and wherein the measuring signals of adjacent measuring points are evaluated regarding the prevalence of rock or coal and depending on this evaluation produces a tilting signal and it is transmitted to the tilting device common to the measuring points, in the sense of climbing when the evaluation shows the prevalence of rock at the evaluated measuring points, and in the sense of plunging when the evaluation shows the prevalence of coal at the evaluated measuring points, and wherein an inclinometer is allocated to each tilting device and wherein, an actual measured value of the inclination of the chute or chute components in the transverse direction of the excavation control device is conveyed as actual value to be compared with the tilting signal produced by the evaluation.

2. A device according to claim 1, wherein during the traveling past in the region of each extraction unit the rock sensor emits a measuring signal for the recognized rock for no more than two measuring points.

3. A device according to claim 1, wherein for the purpose of radio transmission of the rock signals to the nearest radio receiver, each extraction unit and its extraction control device is equipped with a radio receiver and the planer is equipped with a radio transmitter, and wherein the rock signals are assigned to the extraction unit positioned closest to the planer via a position measuring device for the planer's position connected with the extraction control device.

4. A device according to claim 1, wherein in each group of extraction units, which are allocated to a tilting device, at least one extraction control device is equipped with a microprocessor by which tilting signals can be generated for the tilting device allocated to the group, and is further equipped with a program memory, in which the program for the purpose of processing the rock signals and their conversion into tilting signals is stored for the tilting device assigned to the group.

5. A device according to claim 1, wherein each extraction control device is equipped with a microprocessor by which tilting signals can be generated for the tilting device allocated to the group, and is further equipped with a program memory, in which the program for the purpose of processing the rock signals and their conversion into tilting signals is stored for the tilting device assigned to the group.

6. A device according to claim 1, wherein the planer is equipped with a microprocessor, in which a program is stored to process the measured rock signals and to convert them into signals, which can be transferred by the radio transmitter for the purpose of differentiating between coal and rock.

7. A device according to claim 1, wherein each inclinometer is equipped with a radio transmitter for the purpose of transmitting the inclination signals by radio to radio receivers positioned stationarily at distances along the longwall face.

8. A device according to claim 7, wherein to transmit the inclination signals by radio to radio receivers positioned stationarily at distances along the longwall face, each extraction unit and its shield control unit allocated to an inclinometer is equipped with a radio receiver.

9. A device according to claim 8, wherein to supply current to the inclinometer and the functional elements allocated to it, each inclinometer is fitted with a battery.

10. A device according to claim 9, wherein each inclinometer is equipped with a switch to switch on and off the current supply from the battery, and wherein the switching on is carried out via a sensor to determine the approach of the planer travelling past, or via a radio signal emitted by the planer by means of a transmitter mounted on it, and the switching off in a corresponding manner or by a pre-set period of time.

* * * * *

UNITED STATES PATENT AND TRADEMARK OFFICE

CERTIFICATE OF CORRECTION

PATENT NO. : 7,549,709 B2
APPLICATION NO. : 11/855781
DATED : June 23, 2009
INVENTOR(S) : Kussel It is certified that error appears in the above-identified patent and that said Letters Patent is hereby corrected as shown below:

Title page,

Insert the following:

--(30) Foreign Application Priority Data

Mar. 17, 2005 (DE) 10 2005 012 828.9--.

Signed and Sealed this

Twentieth Day of October, 2009

David J. Kappos

David J. Kappos
*Director of the United States Patent and Trademark Office*